United States Patent [19]

Bressi, Jr.

[11] Patent Number: 5,052,559

[45] Date of Patent: Oct. 1, 1991

[54] FOOD BOX

[76] Inventor: Thomas E. Bressi, Jr., Suite 220, 101 Bryn Mawr Ave., Bryn Mawr, Pa. 19010

[21] Appl. No.: 570,815

[22] Filed: Aug. 22, 1990

[51] Int. Cl.[5] ..... B65D 81/00

[52] U.S. Cl. ..... 206/525; 229/906; 229/DIG. 14; 426/124; 426/128

[58] Field of Search ..... 206/521, 525; 229/104, 229/902, 906, DIG. 14; 426/106, 110, 115, 118, 124, 128

[56] References Cited

U.S. PATENT DOCUMENTS

| | | | |
|---|---|---|---|
| 3,640,209 | 2/1972 | Wilson | 426/124 |
| 4,190,757 | 2/1980 | Turpin et al. | 426/107 |
| 4,260,060 | 4/1981 | Faller | 229/906 |
| 4,373,636 | 2/1983 | Hoffman | 206/551 |
| 4,441,626 | 4/1984 | Hall | 229/DIG. 14 |
| 4,831,224 | 5/1989 | Keefer | 426/107 |
| 4,891,482 | 1/1990 | Jaeger | 426/107 |
| 4,954,385 | 9/1990 | Sämann | 206/521 |

*Primary Examiner*—Jimmy G. Foster

*Attorney, Agent, or Firm*—Norman E. Lehrer; Franklyn Schoenberg

[57] ABSTRACT

A package device is provided for transporting heated carry-out food by a consumer which includes a box within which the food may be securely carried and support members to elevate the heated food from the bottom surface of the box, thus preventing the bottom portion of the food from becoming soggy while it is being transported.

7 Claims, 2 Drawing Sheets

FOOD BOX

FIELD OF THE INVENTION

This invention is directed to a package device and, more particularly, to a food carrier box for hot carry-out foods from restaurants and the like which includes support members to elevate the hot food from the bottom of the box, thus maintaining the edible quality by preventing the crust and bottom portion of the food from becoming soggy while it is being transported.

BACKGROUND OF THE INVENTION

In the field of packaging prepared carry-out food for consumption off-premises or at home, it has been common practice to develop packaging which provides protection of the food during customer handling and transport while allowing the prepared food to be maintained at edible temperatures and quality as long as is consistent with the needed protection. In this connection, there Schubert, U.S Pat. No. 4,373,636 to Hoffman and U.S. Pat. No. 4,441,626 to Hall packaging for heated carry-out food which would assist in maintaining the quality of the heated food until ready for off-premises consumption by the consumer.. Also suggested is packaging for prepared food in which the food could be heated by a consumer without removing the same from the box, such as disclosed in U.S. Pat. No. 4,260,060 to Faller.

Notwithstanding many years of effort in this field, there is a need to provide relatively low cost and environmentally suitable packaging for the increasing varieties of carry-out foods and the like prepared for off-premises consumption which securely protects the food while enabling the quality and temperatures to be maintained, i.e. edible temperature, crispness, and the like, without the need for further preparation by the customer.

SUMMARY OF THE INVENTION

It is accordingly an object of the present invention to provide secure packaging for prepared carry-out food which is low cost, easy to store and use, and which enables the edible quality of the food such as heated fast foods, i.e., sandwiches and the like, to be maintained for off-premises consumption by the consumer.

It is another object of the invention to provide low cost packaging for heated carry-out foods such as sandwiches and the like which can be readily used to provide support for the food from the bottom of the package to maintain the edible quality of the bottom of the food.

It is a further object of the present invention to provide low-cost packaging for heated carry-out food having support members integral with the packaging which do not interfere with the shipping or storage thereof but is readily adaptable for providing generally uniform support for the heated food when packaged for transport by the consumer to maintain the edible quality of the bottom surface of the food.

It is a still further object of the present invention to provide a covered box having support strips secured to the inside surface of the bottom wall thereof which do not interfere with the storing or shipping of the box: before use but are readily adaptable for providing generally uniform secure support for heated carry-out food such as sandwiches and the like which is separated from the bottom wall of the bcx to maintain the edible quality of the bottom portion of the food.

In accordance with the present invention there is provided a package device for heated carry-out food comprising:

(a) a box having a first pair of two opposed spaced apart side walls, a second pair of two opposed spaced apart side walls juxtaposed to said first pair and opposed spaced apart top and bottom walls;

(b) a plurality of spaced apart support means secured in parallel alignment to said bottom wall for generally uniformly supporting a heated carry-out food item within said box spaced away from said bottom wall.

Other objects, features and advantages of the present invention will be readily apparent from the following detailed description of the preferred embodiment thereof taken in conjunction with the drawings.

BRIEF DESCRIPTION OF THE DRAWINGS

For the purpose of illustrating the invention, there is shown in the drawings one form which is presently preferred; it being understood that the invention is not intended to be limited to the precise arrangements and instrumentalities shown.

DESRIPTION OF THE PREFERRED EMBODIMENT

Figure 1:
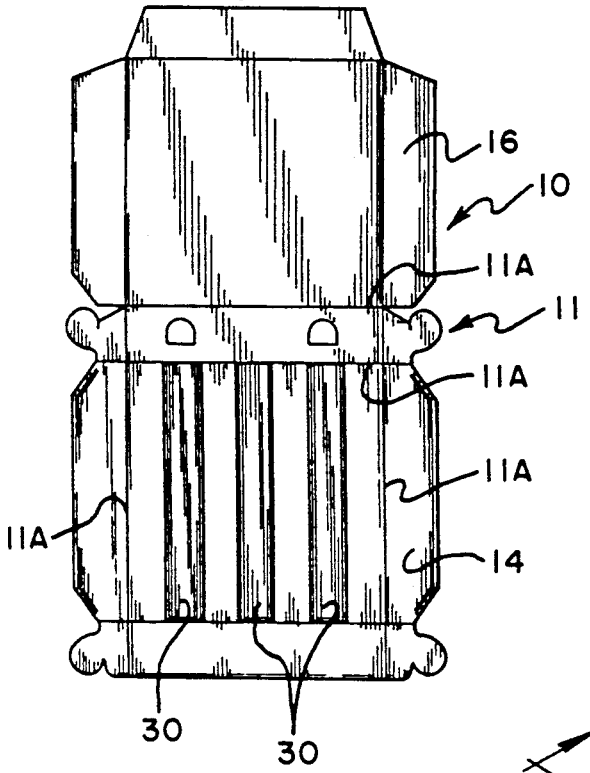
FIG. 1 shows a top plan view of a preformed sheet of components suitable for assembly into a package device in accordance with the present invention.
Figure 2:
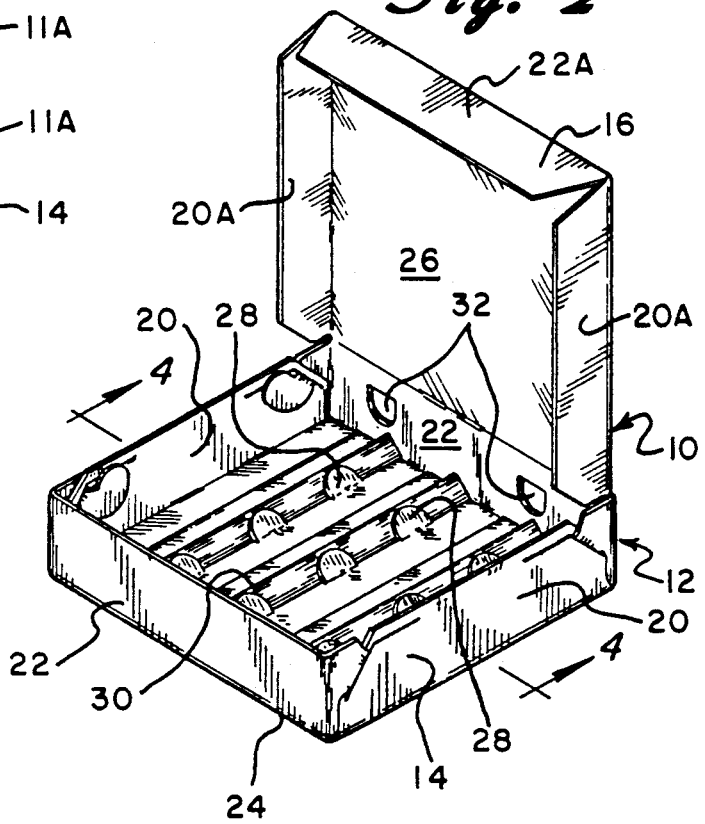
FIG. 2 is a perspective view of a package device of the present invention.
Figure 3:
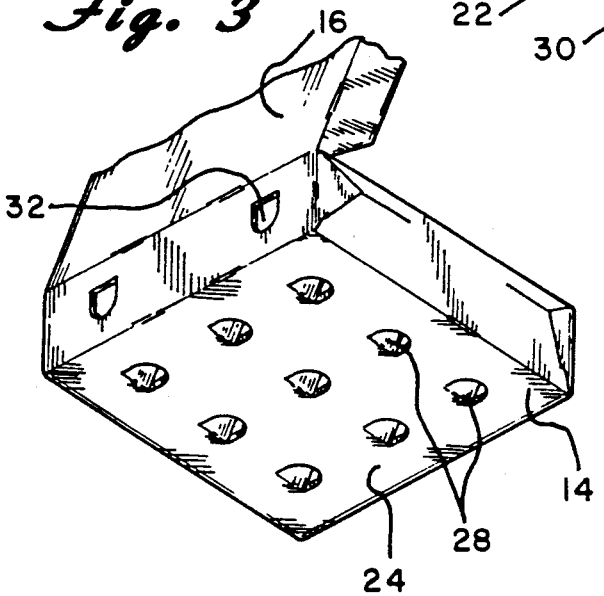
FIG. 3 is a bottom view, in perspective, partially broken away, of the package device of FIG. 2.

Referring to the drawings in detail wherein like reference numerals identify like elements throughout the various figures, there is illustrated in FIGS. 1 to 6 a package device according to the invention shown generally as 10. The package device 10 of the invention is shown in FIG. 1 as a disassembled preform 11 with scored fold lines llA, key tabs, key-tab slots and secured support strips 30, the form which is suitable for shipping and storage, and is shown in FIG. 2 in assembled "box shaped" configuration 12 with support strips 30 secured to the bottom wall of the container section 14 and adapted for support of a food item to be packaged; the lid or cover section 16 of the box 12 being open.

The package device 10 of the invention includes a rectangular box 12 of generally conventional construction which is typically formed from two mating sections, a bottom container section 14, and a cover section 16. The device of the present invention, however, includes three support strips 30 which are arranged and secured in spaced parallel relationship as hereinafter described to the bottom wall 24 of the container section 14 of the box 12.

Figure 4:
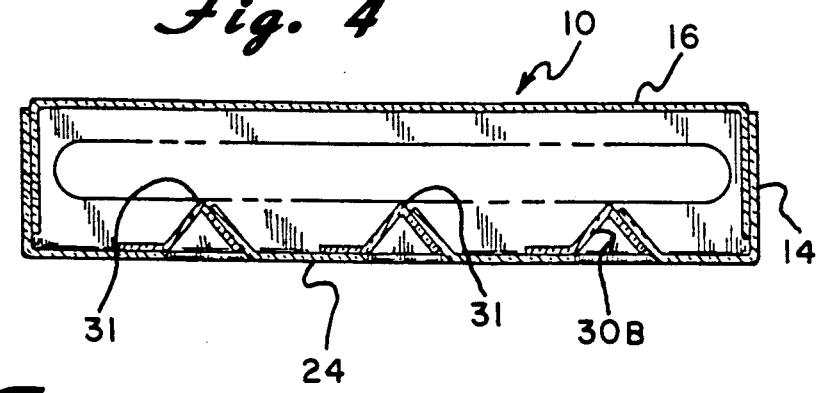
FIG. 4 is a sectional view, taken along line 4—4 of FIG. 2 with the cover section of the device closed and a typical carry-out food item disposed therein.

The bottom container section 14 of the box 12 has opposing side walls 20, opposing front and back walls 22 and a substantially planar bottom wall 24. The cover section 16 has a substantially planar top wall 26 with front flap 22A and side flaps 20A extending outwardly therefrom which are intended to be snugly received within the side walls of the container section 14 when the box 12 is closed (FIG. 4).

As indicated, secured to the bottom wall 24 in spaced parallel relationship are three support strips which extend substantially between the front and back walls 22 of the container section 14. Also provided in the bottom wall 24 are a plurality of support tabs 28 in the form of scored semi-circular punch-outs which are arranged in the bottom wall 24 in a spaced parallel alignment which is coordinated with the alignment of the support strips 30. The walls of box 12 are formed typically from stiff paper-board, cardboard or similar conventional box making materials which are of sufficient strength to provide protection for food items packaged therein as well as being sufficiently supportive for support tabs 28 and the like which may be formed in the walls thereof.

Support strips 30 are elongated strips of relatively rigid materials such as the paper-board or cardboard used in the construction of the boxes 12 or may be prepared from other materials such as plastics and the like which can be readily formed into supportive channels in accordance with the present invention as well as being readily adhered to other materials by conventional bonding procedures. Support strip 30 is formed from a single length of material which is scored or partially cut along the length thereof to provide three contiguous elongated legs of essentially equal widths. Two adjacent legs thereof are adaptable for the formation thereby of a channel-like configuration 30B which overlies the bottom wall 24, with the third leg of the strip 30 providing a flange portion 30A which is contiguous with the length of the two channel forming legs.

Figure 5:
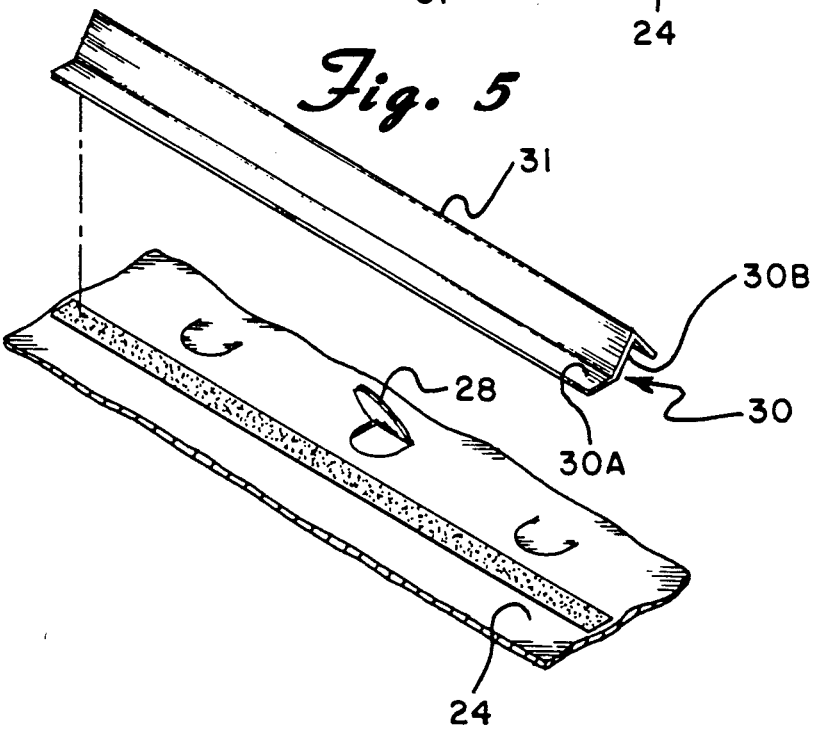
FIG. 5 shows an enlarged and fragmentary exploded view, in perspective, of the bottom wall and support strip of the package device of FIG. 2.
Figure 6:
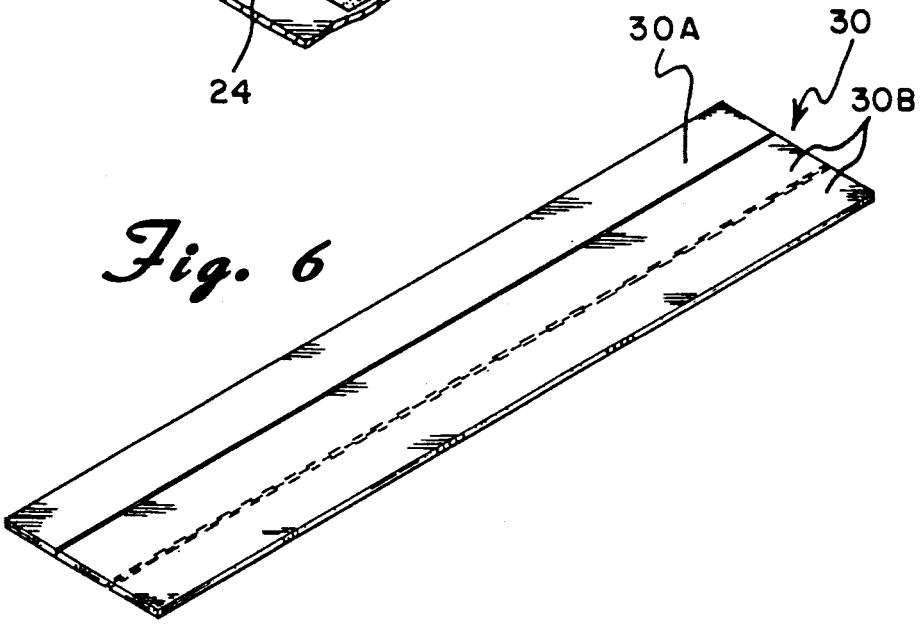
FIG. 6 is an enlarged top view, in perspective, of a support strip member of the package device in accordance with the invention.

As shown in FIG. 5, flange portion 30A of the support strip 30 is bonded by conventional adhesives and methods to the bottom wall 24 of the box 12 with the channel forming legs of the strip being arranged to overlie support tabs 28 which have been preformed in the bottom wall 24 of the box 12. By virtue of the interaction of the secured leg **30*a* of support strip 30 and the restraint provided by support tabs 28 for the channel forming legs of the strip 30, an elongated rib is formed in the container section 14 of the box 12, the vortex 31 of which is spaced from the bottom wall 24 and is suitable to support a food item that may be placed thereon. In the preferred embodiment shown in FIG. 4, the use of three support strips in the package device 10, provides a substantially uniform support for maintaining a food item such as a sandwich separated from the bottom wall of the box 12** while providing secure support within the box.

Also provided in the package device of the invention are vent holes 32 which, when desired, permit ventilation of the interior of the box 12 in the event that it may be required for the transport of certain types of heated carry-out foods.

As should be readily apparent to those skilled in the art, packages or boxes of the present invention can be manufactured and shipped in their flat form as shown in FIG. 1. When it is desired to utilize a package one merely needs to fold the parts thereof on the score lines and insert the corner retaining tabs in the conventional manner. Thereafter, the support strips 30 are folded into their triangular form as shown in FIG. 5. The support tabs 28 are then pushed upwardly from the bottom of the box and the forward free ends of the strips 30 are inserted thereunder to maintain the strips in position as shown in FIG. 2. This arrangement prevents the bottom of a sandwich or other food item from becoming soggy.

Having thus described the invention in relation to the drawings hereof, it will be clear that modifications could be made in the preferred embodiments without departing from the spirit of the invention. Accordingly, it is not intended that the words used to describe the invention be limiting thereof nor should the drawings be considered so. It is intended that the invention be limited only by the scope of the appended claims.

What is claimed is:

1. A package device for heated carry-out food comprising:

(a) a box having a first pair of two opposed spaced apart side walls, a second pair of two opposed spaced apart side walls uxtaposed to said first pair of side walls and opposed spaced apart top and bottom walls;

(b) a plurality of elongated separate support means secured in spaced parallel alignment to said bottom wall on its interior side adapted for supporting a heated carry-out food within said box in a portion spaced away from said bottom wall, each of said support means being secured along one elongated edge thereof to said bottom wall interior side.

2. The package device as claimed in claim 1, wherein each of said support means include elongated continuous support strips adaptable to from an inverted channel with said bottom wall interior side with the legs thereof being restrained and the vortex of each channel providing substantially continuous uniform means upon which a food item may be supported separate from said bottom wall with said bottom wall exterior side being substantially planar.

3. The package device as claimed in claim 2, wherein said elongated continuous support strips extend between and substantially about the opposing side walls of said box.

4. The package device as claimed in claim 2, wherein one elongated edge of each of said support strips is adhered to said bottom wall.

5. A carton for heated carry-out food comprising:

(a) a box having a first pair of two opposed spaced apart side walls, a second pair of two opposed spaced apart side walls juxtaposed to said first pair of side walls and opposed spaced apart substantially planar top and bottom walls;

(b) at least two elongated longitudinally hinged support strips secured along one longitudinal edge in spaced substantially parallel alignment to said bottom wall interior surface, each of said strips being adapted to form an inverted substantially continuous channel overlying said bottom wall interior side with the elongated legs thereof being restrained to provide a support on the bottom wall interior side upon which a heated food item may be disposed spaced from the bottom wall interior side.

6. The carton as claimed in claim 5, wherein each of said support strips substantially extends between one pair of said opposing side walls.

7. The carton as claimed in claim 5, wherein said bottom wall is cut to define a plurality of tabs adapted to be displaced upwardly from the plane of said bottom wall, said tabs being cut in said bottom wall in longitudinal alignment with each of said elongated support strips with the support strips substantially overlying the tabs cut in said bottom wall.

* * * * *

UNITED STATES PATENT AND TRADEMARK OFFICE

CERTIFICATE OF CORRECTION

PATENT NO. : 5,052,559

DATED : October 1, 1991

INVENTOR(S) : Thomas E. Bressi, Jr.

It is certified that error appears in the above-identified patent and that said Letters Patent is hereby corrected as shown below:

Column 1, line 22, after "there" read --has been suggested, for example, in U.S. Patent 4,253,060 to--

Column 4, line 17, "uxtaposed" is changed to --juxtaposed--

Column 4, line 23, "portion" is changed to --position--

Column 4, line 29, "from" is changed to --form--

Column 4, line 32, the word --a-- is inserted before "substantially"

Column 4, line 38, "about" is changed to --abut--

Signed and Sealed this

Fourteenth Day of June, 1994

Bruce Lehman

*Attest:*

BRUCE LEHMAN

*Attesting Officer*

*Commissioner of Patents and Trademarks*